US007497103B1

(12) United States Patent
Misner

(10) Patent No.: US 7,497,103 B1
(45) Date of Patent: Mar. 3, 2009

(54) DUAL-ACTING LATCH AND STRIKE

(75) Inventor: Michael O. Misner, Lake Villa, IL (US)

(73) Assignee: The Eastern Company, Wheeling, IL (US)

( * ) Notice: Subject to any disclaimer, the term of this patent is extended or adjusted under 35 U.S.C. 154(b) by 0 days.

(21) Appl. No.: 11/715,177

(22) Filed: Mar. 7, 2007

Related U.S. Application Data

(60) Provisional application No. 60/794,214, filed on Apr. 22, 2006.

(51) Int. Cl.
*E05B 63/14* (2006.01)

(52) U.S. Cl. ..... 70/103; 70/116; 70/120; 292/36; 292/97; 292/129; 292/177; 292/DIG. 55; 292/DIG. 73

(58) Field of Classification Search ..... 70/102, 70/103, 116, 120, 123; 292/32, 36, 37, 95, 292/97–99, 102, 106, 116, 117, 129, 137, 292/140, 146, 150, 177, 186, 229, DIG. 39, 292/DIG. 40, DIG. 41, DIG. 51, DIG. 55, 292/DIG. 73
See application file for complete search history.

(56) References Cited

U.S. PATENT DOCUMENTS

| | | | | | |
|---|---|---|---|---|---|
| 406,903 | A | | 7/1889 | Hebert | 292/34 |
| 441,674 | A | | 12/1890 | Kubler | 70/82 |
| 745,664 | A | | 12/1903 | Reiger | 70/70 |
| 789,775 | A | | 5/1905 | Ward | 70/106 |
| 1,143,653 | A | | 6/1915 | Smith | 70/97 |
| 1,366,706 | A | | 1/1921 | Schoell | 70/103 |
| 1,410,581 | A | | 3/1922 | Langer | 70/97 |
| 1,426,122 | A | * | 8/1922 | Stern | 70/103 |
| 1,510,561 | A | | 10/1924 | Segal | 70/103 |
| 1,512,141 | A | | 10/1924 | Segal | 70/106 |
| 1,520,976 | A | | 12/1924 | Stern | 70/103 |
| 1,524,048 | A | * | 1/1925 | Maliin | 70/103 |
| 1,526,110 | A | * | 2/1925 | Bachmann | 70/120 |
| 1,533,629 | A | | 4/1925 | Best | 70/82 |
| 1,546,645 | A | * | 7/1925 | Freysinger | 70/131 |
| 1,563,914 | A | | 12/1925 | Muzzio | 70/123 |
| 1,564,883 | A | | 12/1925 | Muzzio | 70/365 |
| 1,601,359 | A | | 9/1926 | Harrington | 70/100 |
| 1,836,209 | A | * | 12/1931 | Viehweger | 70/103 |
| 1,977,853 | A | | 10/1934 | Kemp | 70/74 |
| 2,002,014 | A | * | 5/1935 | Kemp et al. | 70/118 |
| 2,004,746 | A | * | 6/1935 | Boyko | 70/104 |
| 2,173,671 | A | | 9/1939 | Webber | 292/25 |
| 2,181,393 | A | | 11/1939 | Crooks | 292/25 |
| 2,224,671 | A | | 12/1940 | Crooks | 70/151 |
| 2,720,774 | A | | 10/1955 | Gehrie | 70/71 |

(Continued)

*Primary Examiner*—Lloyd A Gall
(74) *Attorney, Agent, or Firm*—David A. Burge

(57) ABSTRACT

A latch has a pair of oppositely acting latch bolts slidable on a housing that are engageable with latching formations on a strike. The housing has a pair of substantially parallel posts configured to shield portions of the latch bolts during insertion into and withdrawal from openings defined by the strike. A plug is turnable on the housing to slide the latch bolts toward and away from each other between latched and unlatched positions. In lockable embodiments of the latch, the plug may be provided with a keyway into which a key can be inserted and turned to move the latch bolts; and, in some embodiments, the latch bolts are retained in their latched positions when the key is removed.

17 Claims, 7 Drawing Sheets

U.S. PATENT DOCUMENTS

| | | | | |
|---|---|---|---|---|
| 2,887,865 | A | 5/1959 | Moler | 70/149 |
| 2,943,878 | A | 7/1960 | Rigaud | 292/44 |
| 3,177,022 | A | 4/1965 | McKee et al. | 292/50 |
| 3,532,373 | A | 10/1970 | Poe | 292/47 |
| 3,603,632 | A | 9/1971 | Grass | 292/224 |
| 3,857,594 | A | 12/1974 | Pastva, Jr. | 292/27 |
| 3,899,201 | A | 8/1975 | Paioletti | 292/25 |
| 4,534,191 | A | 8/1985 | Rogers et al. | 70/116 |
| 4,836,707 | A | 6/1989 | Myers | 403/322 |
| 5,171,048 | A | 12/1992 | Weinerman et al. | 292/45 |
| 5,192,096 | A | 3/1993 | Weinerman et al. | 292/45 |
| 5,193,861 | A | 3/1993 | Juga et al. | 292/49 |
| 5,209,530 | A | 5/1993 | Kolloch | 292/27 |
| 5,402,662 | A * | 4/1995 | Osada | 70/491 |
| 5,516,162 | A | 5/1996 | Takaishi | 292/37 |
| 5,791,171 | A | 8/1998 | Kelley | 70/58 |
| 5,823,030 | A * | 10/1998 | Theriault et al. | 70/419 |
| D408,711 | S | 4/1999 | Bianco | D8/331 |
| 5,907,962 | A | 6/1999 | Smithson et al. | 70/58 |
| D435,427 | S | 12/2000 | Sokurenko | D8/331 |
| D436,833 | S | 1/2001 | Turner et al. | D8/331 |
| 6,474,118 | B2 | 11/2002 | Martinez | 70/123 |
| 7,063,361 | B1 * | 6/2006 | Lawrence | 292/241 |
| D532,674 | S | 11/2006 | Schwalie et al. | D8/331 |

* cited by examiner

DUAL-ACTING LATCH AND STRIKE

REFERENCE TO PROVISIONAL AND DESIGN APPLICATIONS

This application claims the benefit of the filing by Michael O. Misner on Apr. 22, 2006 of provisional application Ser. No. 60/794,214, the disclosure of which is incorporated herein by reference.

Reference also is made to a design application Serial No. 29/258,512 filed Apr. 22, 2006 by Michael O. Misner, the disclosure of which is incorporated herein by reference.

BACKGROUND

In U.S. Pat. No. 6,474,118 entitled SCISSORS LATCH LOCK issued Nov. 5, 2002 to Richard A. Martinez, the disclosure of which is incorporated herein by reference, a lockable latch and strike are disclosed that can be mounted on members, structures or devices that are to be moved toward each other to close or closed positions that are to be secured by locked engagement of the latch with the strike. Toward this end, the latch has a generally rectangular housing from which extends a single post-like projection having a tapered outer end that facilitates insertion of the post-like projection into a single opening defined by the strike.

The latch of the aforementioned Martinez patent also has a pair of latch bolts, inner end regions of which extend into and are pivotally connected to the housing. Outer end regions of the latch bolts are movable between unlatched and latched positions. When in the unlatched positions, the latch bolts reside closely alongside the single post-like projection of the latch in a tight, compact array that facilitates inserting the outer end region of the post-like projection and the outer end regions of the latch bolts into the single opening of the strike. When in the latched positions, the outer end regions of the latch bolts project away from each other and from opposite sides of the single post-like projection to enable the bolt-carried tooth formations to engage latching formations that are defined by the strike at locations near opposite end regions of the single opening of the strike.

When the latch of the Martinez patent is to engage its strike, the outer end region of the post-like projection and the outer end regions of the latch bolts are inserted in a tightly grouped array into the opening of the strike, whereafter the outer end regions of the latch bolts are moved away from each other and away from opposite sides of the post-like projection of the latch to engage the latching formations of the strike. When the outer ends of the latch bolts and the post-like projection are in a tightly grouped array that permits their being inserted into and withdrawn from the strike's opening, the latch bolts are said to be in their unlatched positions. When the outer end regions of the latch bolts are moved away from each other and away from opposite sides of the outer end region of the post-like projection to bring the tooth formations into latching engagement with the latching formations of the strike, the latch bolts are said to be in their latched positions.

If the outer end region of either of the latch bolts latchingly engages its associated strike-defined latching formation, the latch is, in fact, latched into engagement with the strike because even one such latching engagement prevents the latch from being moved out of engagement with the strike. Thus, only when neither of the latch bolts latchingly engages its associated strike-defined latching formation is the latch actually unlatched from the strike because only then can the latch be separated from the strike by withdrawing the latch bolts and the post-like projection from the single opening of the strike.

Although the latch bolts of the lockable latch disclosed in the Martinez patent do not rely on housing-carried springs to establish or to maintain their latched engagement with the strike, the latch does rely on a pair of housing-carried springs to disestablish latched engagement of the latch with the strike by moving the outer end regions of both of the bolts from their extended latched positions to their retracted unlatched positions so the post-like projection and the latch bolts can be withdrawn from the opening of the strike.

Each of the housing-carried springs of the latch disclosed in the Martinez patent is relatively small and relatively weak. Each of these springs biases only an associated one of the two latch bolts toward its unlatched position. Neither of these springs serves to "backup" the action of the other. If one should fail to perform its intended function, the other is not designed to attempt to perform the function of the spring that failed. Thus, if one or both of these relatively small, relatively weak housing-carried springs should fail (for example, as the result of fatigue, breakage or simply due to its insufficiently small biasing force) to retract one or both of the latch bolts at a time when an owner operator has used a correctly configured key to turn a key-operated plug of the latch from the locked position to the unlocked position, the latch will remain in latched engagement with the strike—which is to say that the latch will not respond, as intended, to the unlocking efforts of the owner operator to release its engagement with the strike.

Because the tooth formations on the outer end regions of the latch bolts of latches of the type disclosed in the Martinez patent often tightly engage the latching formations of their associated strikes, the relatively weak housing-carried springs of these latches sometimes fail to dislodge, release and move the tooth formations from latchingly engaging the associated strikes. Thus, it is known for one or both of the latch bolts to remain stuck in latched engagement with the strike, which prevents withdrawal of the post-like projection and the associated latch bolts from the strike opening.

In other words, the latch does not release: it does not unlatch despite repeated turnings of the key-operated plug of the latch from the locked to the unlocked position. And, when repeated turnings of the key-operated plug of one of these latches (from locked to unlocked positions) brings no corresponding unlatching movement of one or both of the associated latch bolts, the owner operator may become frustrated, and may be inclined to pound or pry on the latch and/or the strike in an effort to dislodge the stuck latch bolts so they will move properly to their unlatched positions under the influence of their housing-carried springs.

Because latch damage may occur if latches or their associated strikes are pounded or pried on during efforts to dislodge and jar loose one or both of the toothed latch bolts from latched engagement with the associated strike, a need exists for an improved form of latch that includes a mechanism designed to effect positive movement of the associated latch bolts from latched to unlatched positions when the associated key-operated plug is turned from locked to unlocked positions. What is needed is a latch that does not depend on the action of springs to move its latch bolts from latched to unlatched positions, and therefore will not need to be pounded on or pried to jar one or both of its latch bolts out of latched engagement with the associated strike when the key-operated plug of the latch is turned from a locked to an unlocked position.

Yet another shortfall of latches and strikes of the type disclosed in the Martinez patent stems from their reliance on insertion of a single post-like projection of the latch into a single opening of the associated strike to effect proper alignment (of the movable members, structures or devices on which the latches and strikes are mounted) when the latches are to be moved into latching engagement with their associated strikes. Relying on the tapered outer end region of only one post-like projection being inserted into only one strike-defined opening to align members, structures or devices that carry a latch and strike for movement toward close or closed positions that are to be maintained by locked engagement of the latch and strike can prove frustrating and awkward, and can lead to bending or breakage of the single post-like projection and/or the outer end regions of the associated latch bolts, especially if the latch bolts should move away from opposite sides of the post-like projection (where the tooth formations of the latch bolts are intended to be shielded from contact by the post-like projection) thereby exposing one or more of the tooth formations to unwanted contact at the same time that efforts are under way to align and insert the post-like projection into the opening of the associated strike.

An improved latch is desired that provides a stronger and more reliable device than is afforded by a single post-like projection which is intended to be aligned with and inserted into a single strike-defined opening as disclosed in the Martinez patent for aligning latch- and strike-carrying members during their movement toward close or closed positions that are to be maintained by latched engagements of the associated latch bolts with their associated strikes.

SUMMARY OF THE INVENTION

The present invention relates to a latch having a pair of posts that extend from a housing to shield portions of a pair of oppositely movable latch bolts that are insertable with the posts into spaced openings of a strike and are engageable with the strike to retain in close or closed relationship a pair of relatively movable members, structures or devices to which the latch and the strike may be separately connected. In some embodiments, the latch is lockable to retain latched engagement of the latch bolts with the strike.

In some embodiments, a latch has a housing from which project two substantially parallel extending posts configured to be insertable concurrently into openings defined by a strike at locations on opposite sides of a latching formation also defined by the strike. First and second latch bolts are slidable on the housing, each extending along a separate one of the posts to define at least one tooth formation that is engageable with the latching formation when the posts of the latch are inserted into the openings of the strike. A plug is rotatable on the housing and is drivingly connected by first and second links to the first and second latch bolts, respectively. The plug and the links are cooperable to slide the latch bolts toward each other when the plug is turned in one direction, and away from each other when the plug is turned in an opposite direction.

If the latch is to be lockable, then, in some embodiments, the plug is provided with a keyway into which a suitably configured key can be inserted and turned to turn the plug and thereby cause the latch bolts to move toward or away from each other in response to turning the plug clockwise or counterclockwise.

DETAILED DESCRIPTION

Figure 8:
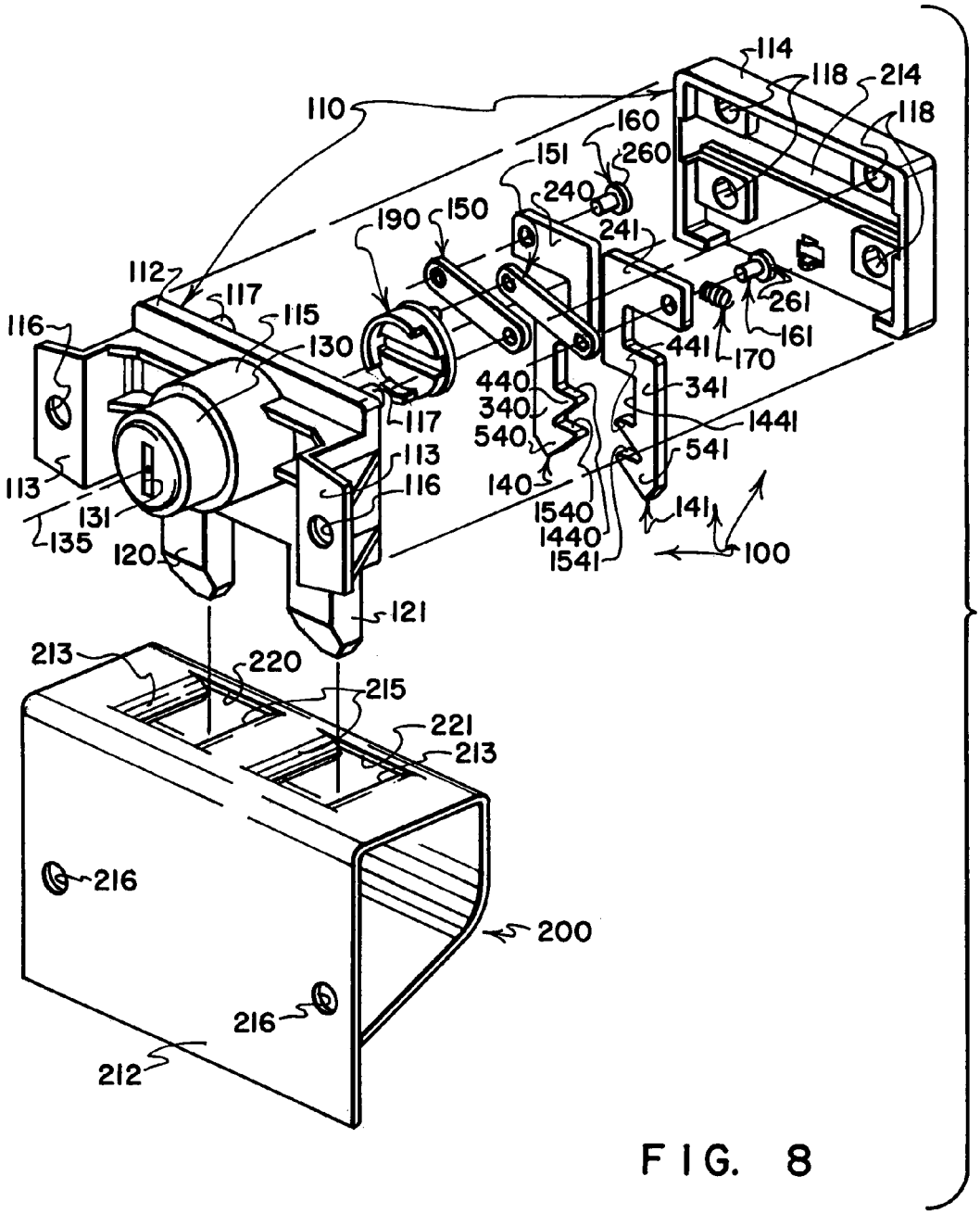
FIG. 8 is an exploded perspective view with selected components of the latch shown separated, and depicting a strike that can be latchingly engaged by the latch bolts of the latch.
Figure 9:
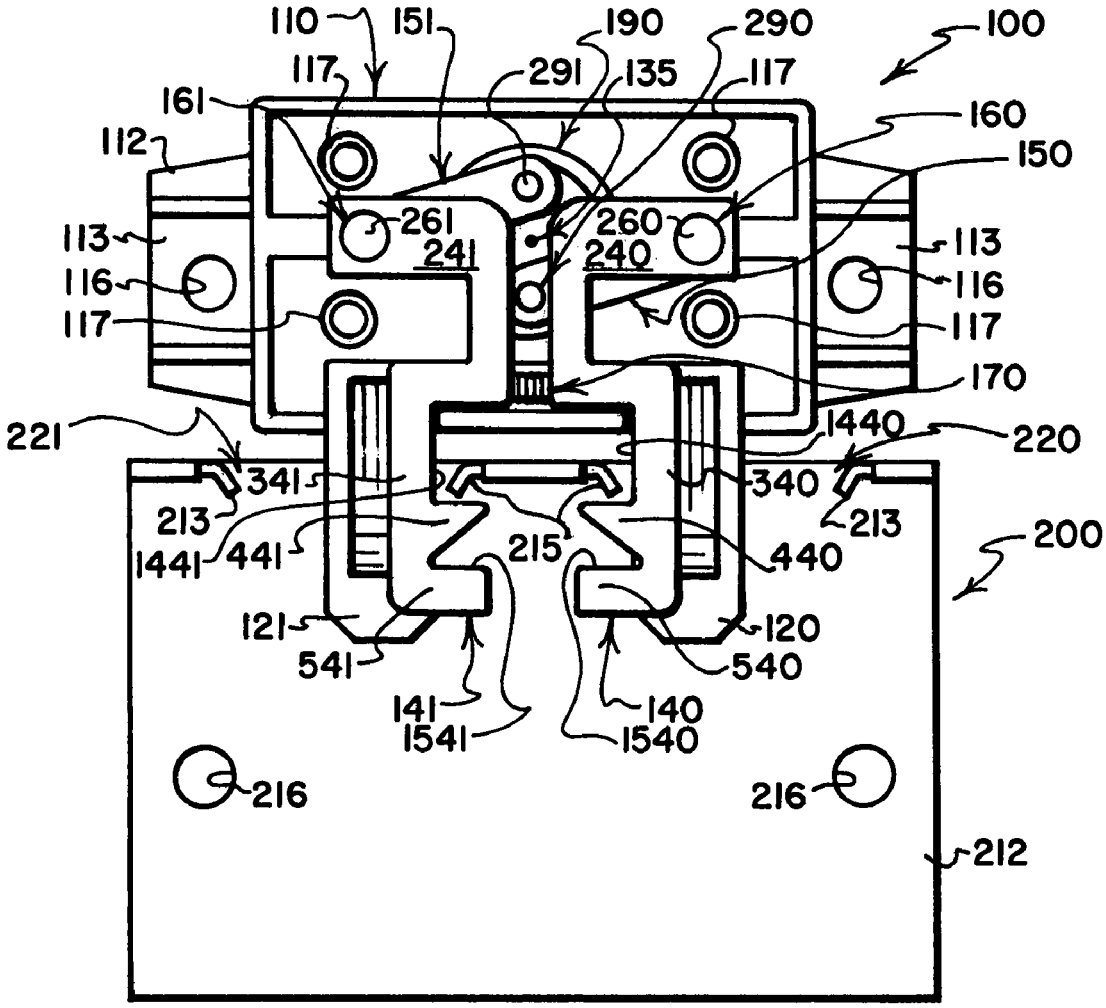
FIG. 9 is a rear view of the latch and the strike with portions of the latch housing and the strike removed so it can be seen that, when the latch is locked with the latch bolts latchingly engaging the strike, the post-like projections extend into separate spaced openings of the strike, and the toothed formations of the latch bolts underlie or extend behind inclined latching formations of the strike that are located near adjacent end regions of the strike's spaced openings; and, FIG. 10 is a view similar to FIG. 9 but with the latch bolts moved relatively away from each other to unlatched positions to permit the post-like projections of the latch to be withdrawn from the openings of the strike.
Figure 10:
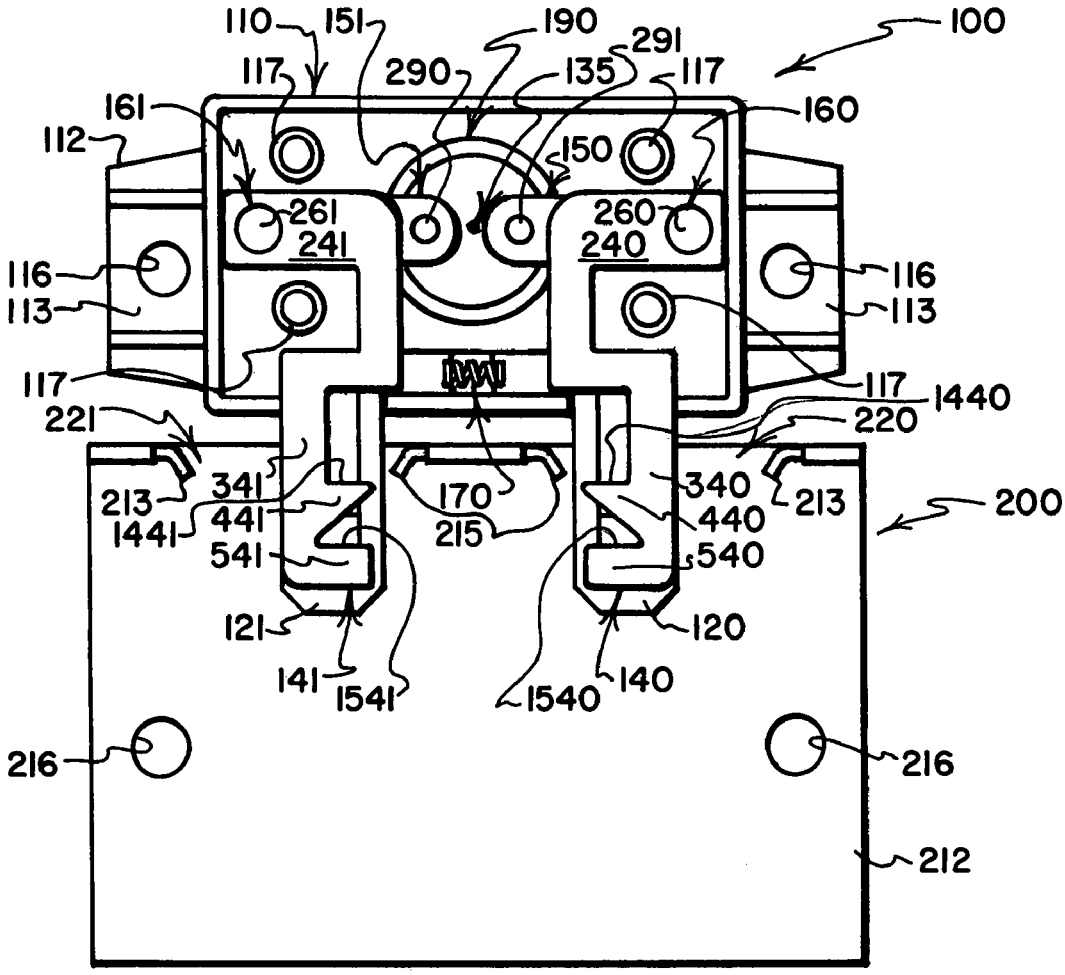

Referring to FIGS. 1-7, a dual-acting latch is indicated generally by the numeral 100. Referring to FIGS. 8-10, one possible embodiment of a strike that can be used with the latch 100 is indicated generally by the numeral 200. In FIG. 8, the latch 100 is shown disengaged from the strike 200. In FIGS. 9 and 10, a pair of post-like projections (or "posts") 120, 121 of the latch 100 are shown extending into spaced-apart elongate openings 220, 221 of the strike 200. In FIGS. 1-4 and 9, oppositely acting latch bolts 140, 141 of the latch 100 are shown in latched positions where tooth formations 440, 441, 540, 541 of the latch bolts 140, 141 project into the space between the posts 120, 121. In FIG. 10, the latch bolts 140, 141 are shown retracted to unlatched positions wherein the tooth formations 440, 441, 540, 541 reside along the rear sides of the posts 120, 121 so as to be protectively shielded by the posts 120, 121 from unwanted engagement.

Figure 1:
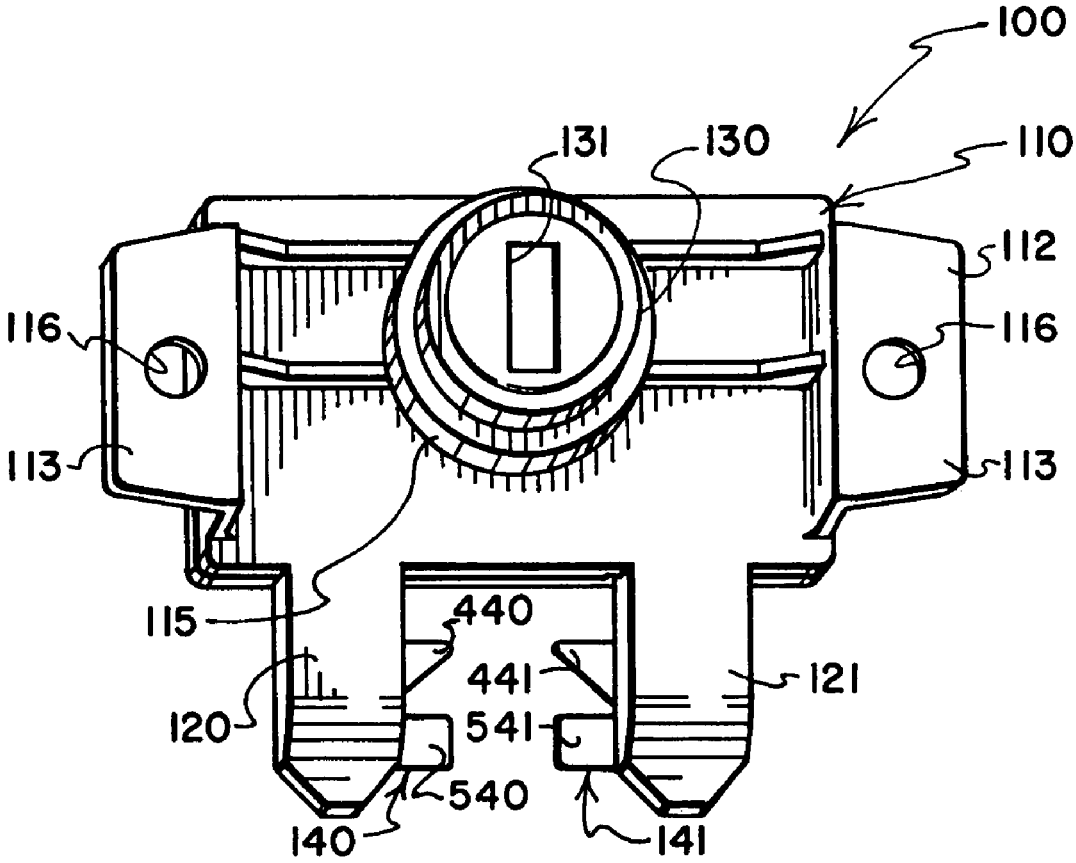
FIG. 1 is a perspective view showing frontal features of a dual-acting latch having a housing that defines spaced post-like projections or "posts" that extend along latch bolts from which tooth formations project into a space between the posts when the latch bolts are in the depicted latched positions.
Figure 2:
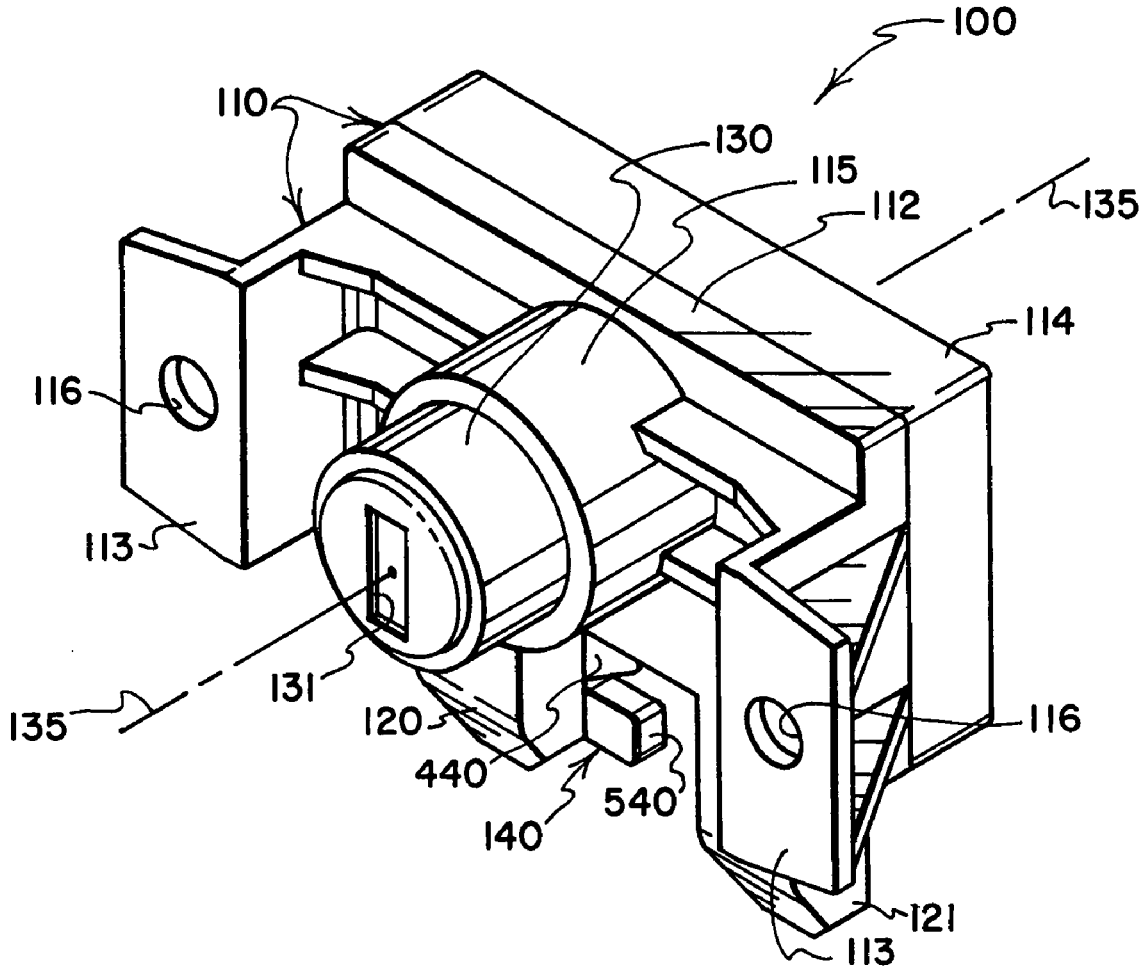
FIG. 2 is another perspective view of the latch which more clearly illustrates three-dimensional aspects of the frontal features of the latch.
Figure 3:
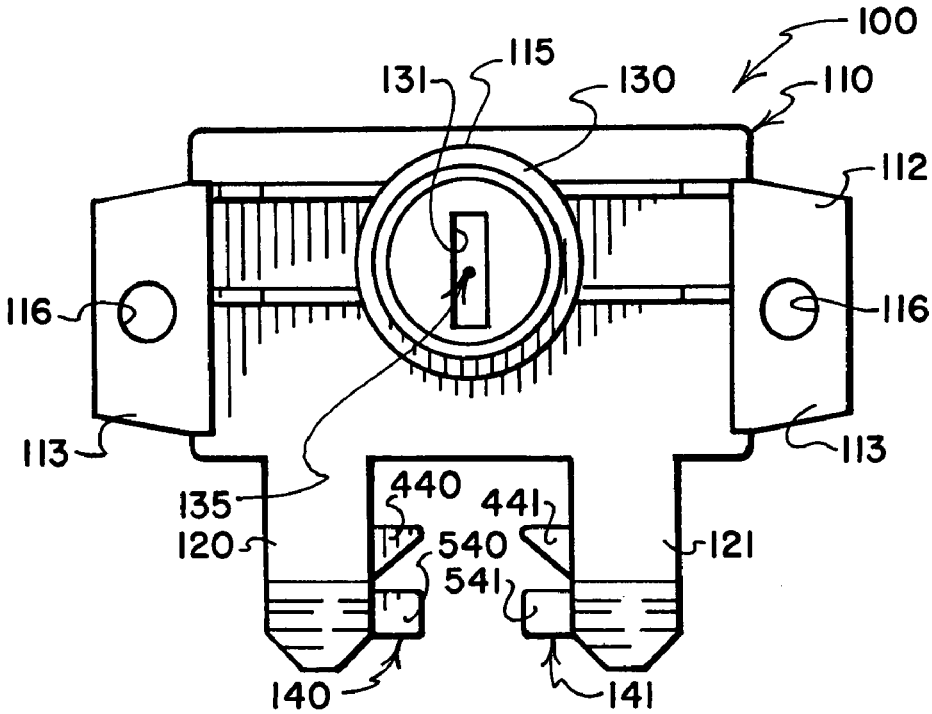
FIG. 3 is a front view of the latch, with the latch bolts thereof still in their latched positions.

Referring to FIGS. 2 and 8, the latch 100 has a housing 110 that is defined by a front member 112 and a rear member 114. The post-like projections 120, 121 are depicted as constituting integrally formed elements of the front member 112, as is a generally cylindrical, forwardly extending, centrally located formation 115 which rotatably mounts a plug 130. If desired, however, the posts 120, 121 can be formed as one or a pair of separate elements of the latch 100, or as integral formations of the rear member 114.

In the latch embodiment shown in the drawings hereof, the plug 130 takes the form of a key cylinder having a forwardly opening keyway 131 into which a conventional, suitably configured conventional key (for example of the type disclosed in the Martinez patent) can be inserted and turned to turn the plug 130 relative to the housing 110 so the latch 100 can be locked after the latch 100 is latchingly engaged with the strike 200 (i.e., after latch bolts 140, 141 of the latch 100 have been moved to the latched position of FIG. 9 to position either the tooth formations 440, 540 or the tooth formations 441, 541 beneath or behind latching formations 215 of the strike 200 to thereby prevent the latch 100 from being moved away from the strike 200, as will be explained shortly).

In non-locking embodiments of the latch 100, a knob or other conventional graspable formation (not shown) is preferably provided near the front of the plug 130 instead of the depicted keyway 131 so the plug 130 can be manually turned to move the latch bolts 140, 141 toward and away from each other in response to turning the plug 130 in one direction or another (i.e., counterclockwise or clockwise) relative to the housing 110 about a forwardly-rearwardly extending axis 135 shown in FIGS. 2 and 5-8.

If the plug 130 is not a lock cylinder but rather is provided with a knob or other form of graspable formation (not shown) that facilitates turning the plug 130, it is preferred that the plug 130 also be provided with one of a wide variety of conventional spring-biased ball detent formations (not shown) that is engageable with one or more recesses (not shown) defined by the housing 110 to assist in releasably retaining or detenting the plug 130 in one or more of the orientations to which it can be turned about the axis 135, preferably including the position shown in FIGS. 1-4 and 9 where the latch bolts 140, 141 are closely spaced for latchingly engaging the latching formations 215 of the strike 200. The incorporation of a spring-ball type detent assembly into a generally cylindrical plug to engage a housing-defined recess to retain the plug in a desired orientation is well known to those skilled in the art.

If the plug 130 is provided with a knob or other graspable formation instead of the depicted keyway 131 (i.e., if the plug 130 does not constitute a lock cylinder into which a key can be turned to move the latch bolts 140, 141 between the positions that are illustrated in FIGS. 9 and 10), then the closely spaced position of the latch bolts 140, 141 shown in FIG. 9 can be thought of as constituting a "latched" position of the latch bolts 140, 141, and the more widely spaced position of the latch bolts 140, 141 shown in FIG. 10 can be thought of as constituting the "unlatched" position of the latch bolts 140, 141 and the various other depicted components of the latch 100. If, however, the plug 130 does, in fact, constitute a lock cylinder, then the positions of the latch bolts 140, 141 depicted in FIGS. 9 and 10 also can be thought of as also showing the "locked" and "unlocked" positions, respectively, of the latch bolts 140, 141 and the various other depicted components of the latch 100.

Figure 4:
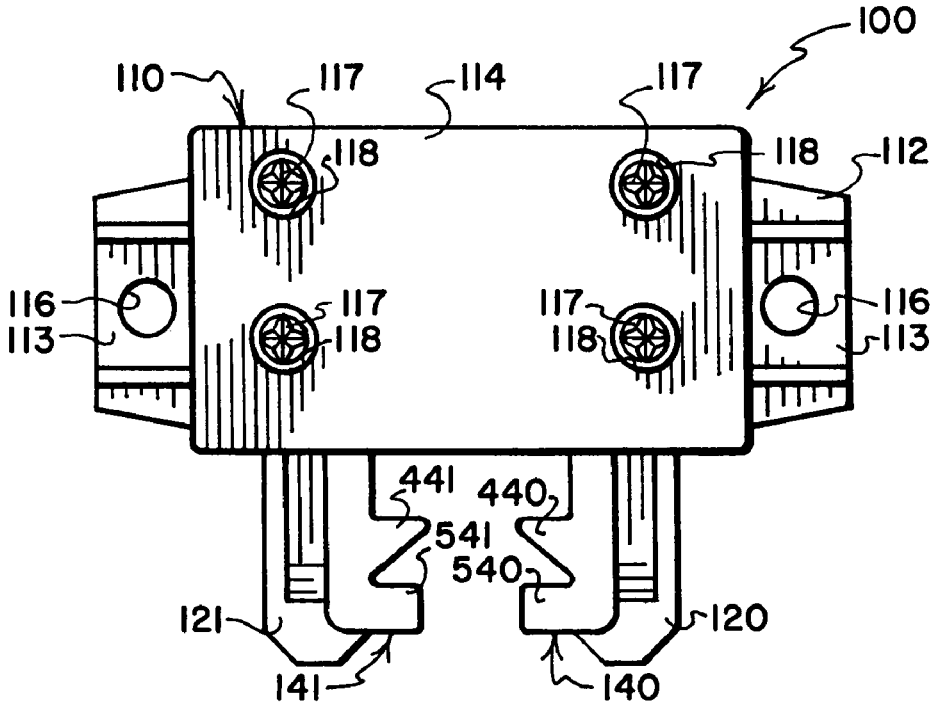
FIG. 4 is a rear elevational view thereof.
Figure 5:
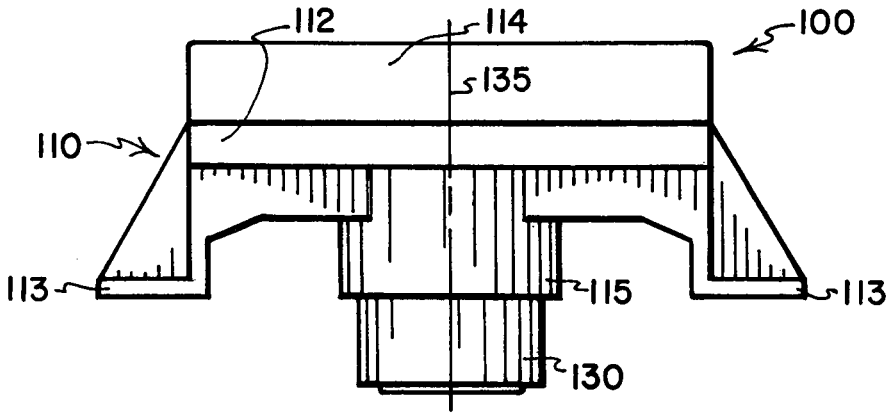
FIG. 5 is a top view thereof.
Figure 6:
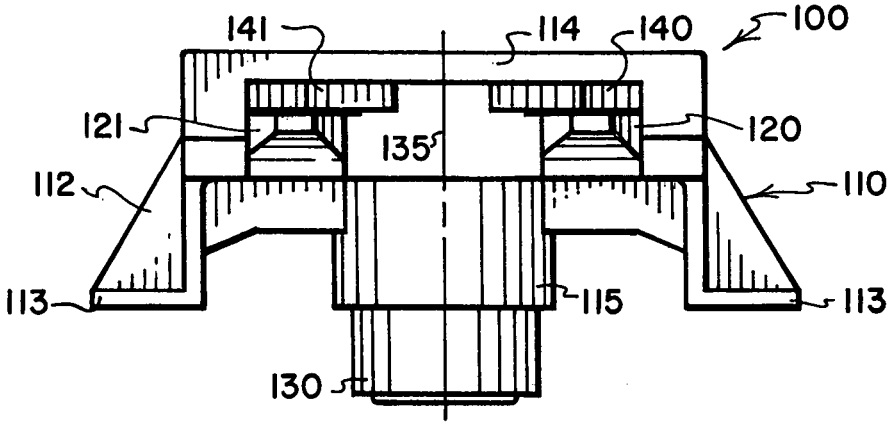
FIG. 6 is a bottom view thereof.
Figure 7:
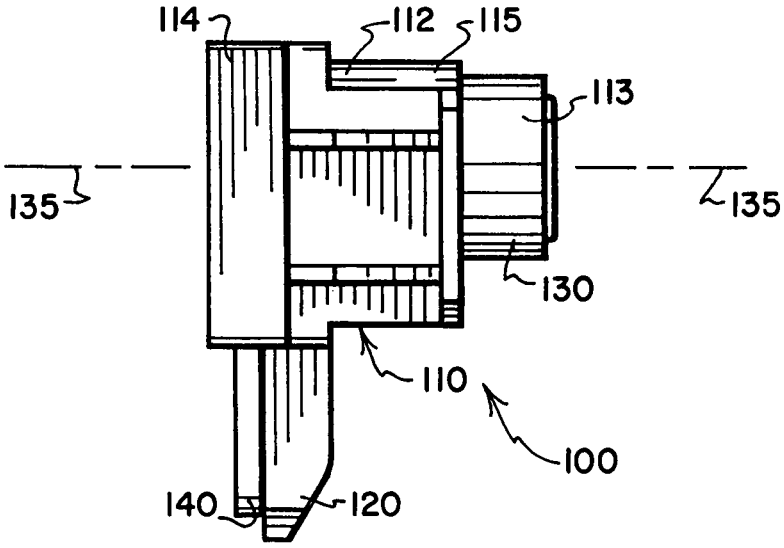
FIG. 7 is a left side view thereof, it being understood that a right side view is identical thereto except for being a mirror image thereof.

Referring to FIGS. 4 and 8-10, one way of connecting the front and rear members 112, 114 of the housing 110 is to provide the front member 112 with rearwardly extending pin-like projections 117 that can extend rearwardly through openings 118 of the rear member 114 where rear ends of the pin-like projections 117 are crimped as shown in FIG. 4 to hold the front and rear members 112, 114 in engagement with each other. In other embodiments, the pin-like projections 117 can be replaced by screws, rivets or other forms of conventional fasteners (not shown) that pass through holes in the front member 112 and extend into the openings 118 of the rear member 114 to clamp the front and rear members 112, 114 together.

Referring to FIG. 8, one way of mounting the latch 100 on a door or other structure (not shown) is to provide the front member 112 with opposed wing-like extensions 113 through which holes 116 are formed to receive suitable conventional mounting fasteners (not shown). In like manner, the strike 200 can be provided with holes 216 through which mounting fasteners (not shown) can extend to mount the strike 200 on a cabinet formation or the like (not shown). In other embodiments, desired features of the strike 200, such as latching formations 215 that are described shortly, can be formed as integral elements of a cabinet or other structure (not shown) adjacent which a door or other structure (not shown) on which the latch 100 may be mounted closes—which is to say that the strike 200 need not take the form depicted herein, and need not constitute a separately formed element of the type shown in the accompanying drawings, so long as suitable structure is provided to define one or more suitably configured latching formations that can be engaged by latch bolts of the latch 100.

Referring to FIGS. 8-10, the depicted strike embodiment 200 is provided with inwardly turned formations 213, 215 at locations adjacent opposite ends of the elongate openings 220, 221 of the strike 200. The inwardly turned formations that are designated by the numerals 215 constitute what are referred herein as "latching formations" of the strike 200. The latching formations 215, as depicted in the drawings hereof, are defined by inwardly turned surfaces of the strike 200 situated at opposite ends of a central portion of the strike 200 that separates the elongate openings 220, 221. In this regard, the entire central portion of the strike 200 that provides the inwardly turned surfaces that form the so-called "latching formations" 215 can be thought of as constituting a single "latching formation," which is what is referred when the singular term "latching formation" is used herein.

Referring to FIGS. 8-10, the latch bolt 140 defines the tooth formations 440, 540 that extend away from adjacent notches 1440, 1540, respectively, into the space between the latch bolts 140, 141. Likewise, the latch bolt 141 defines the tooth formations 441, 541 that extend away from adjacent notches 1441, 1541, respectively, into the space between the latch bolts 140, 141. When one of two conditions exist, the latch 100 is considered to be latched into engagement with the strike 200 or, more simply, "latchingly engaged" by the strike 200.

The latch 100 latchingly engages the strike 200 (i.e., the latch bolts 140, 141 latchingly engage the latching formations 215 of the strike 200) either when one or both of the tooth formations 440, 441 extend(s) beneath or behind one or both of the latching formations 215 in a manner causing one or both of the latching formations 215 to extend into one or both of the notches 1440, 1441 (as is typically depicted in FIG. 9 where the notches 1440, 1441 are shown receiving the latching formations 215), or when one of both of the tooth formations 441, 541 extend(s) beneath or behind one or both of the latching formations 215 in a manner causing one or both of the latching formations 215 to extend into one or both of the notches 1540, 1541. When either of these conditions exists, then the latch 100 is, in fact, "latched" into engagement with the strike 200 because the latch 100 cannot then be moved directly away from the strike 200. The second of these conditions may come to pass when the latch bolts 140, 141 are moved from the retracted positions shown in FIG. 10 toward each other at a time when the posts 120, 121 are not fully inserted into the strike-defined openings 220, 221, which causes the latching formations 215 to enter the notches 1540, 1541 rather than the notches 1440, 1441.

Because the latch bolts 140, 141 move in unison between the retracted/unlatched positions shown in FIG. 10 and the extended/latched positions shown in FIGS. 1-4 and 9 in response to turning of the plug 130 (for reasons that will be explained shortly), the circumstances will be unusual when only one of the latching formations 215 is received in only one of the notches 1440, 1441, 1540 or 1541. Ordinarily, the coordinated, concurrent movement of the latch bolts 140, 141 from the positions shown in FIG. 10 toward the positions shown in FIG. 9 at a time when the posts 120, 121 have been inserted into the openings 220, 221 of the strike 200 will cause the latching formations 215 to concurrently enter either the paired notches 1440, 1441 or the paired notches 1441, 1541. Movement of the latch bolts 140, 141 to the latched positions depicted in FIG. 9 is intended to take place (when the posts 120, 121 of the latch 100 are inserted into the openings 220, 221 of the strike 200) only if such movement causes the latching formations 215 to be substantially concurrently received either in the notches 1440, 1540, or in the notches 1540, 1541.

Because the latching formations 215 are situated relatively close together, it is possible for the latching formations 215 (and the central portion of the strike 200 that defines the latching formations 215) to pass between the post-like formations or posts 120, 121 of the latch 100 as the posts 120, 121 are inserted into the spaced openings 220, 221 of the strike 200. Because the latch bolts 140, 141 are not intended to be "slammed" into latched engagement with the strike 200, the latch 100 must be prepared prior to being engaged with the strike 200 by turning the plug 130 to retract the latch bolts 140, 141 to the positions shown in FIG. 10 where the tooth formations 440, 441, 540, 541 carried by the latch bolts 140, 141 are withdrawn from projecting into the space between the posts 120, 121 (as shown in FIGS. 1-4 and 9) to the position of FIG. 10 wherein the tooth formations 440, 441, 540, 541 extend along rear sides of the posts 120, 121 so the posts 120, 121 protect the tooth formations 440, 441, 540, 541 from accidentally being engaged by portions of the strike 200 during insertion of the posts 120, 121 into the strike-defined openings 220, 221.

Turning the plug 130 approximately a quarter turn in one direction causes the latch bolts 140, 141 to move from the retracted, spaced-apart, unlatched or unlocked positions of FIG. 10 to the extended, closely spaced, latched or locked positions of FIG. 9. When the latch bolts 140, 141 are moved to the closely spaced positions shown in FIG. 9 at a time after the posts 120, 121 and associated portions of the latch bolts 140, 141 have been inserted into the openings 220, 221 of the strike 200, the latch 100 is said to be "latchingly engaged" by the strike, and the latch bolts 140, 141 are considered to be "latchingly engaged" by the strike's latching formations 215—and this is true regardless of whether any of the tooth formations 440, 441, 540, 541 actually engages either of the latching formations 215.

If the plug 130 is a key cylinder, then the plug 130 preferably is internally structured in any of a variety of conventional ways that are well known to those who are skilled in the art to enable the suitably configured key to be inserted into and removed from the keyway 131 when the plug 130 is turned to one or more desired orientations, in this case preferably only when the key cylinder 130 is turned to the locked position shown in FIGS. 1, 3, 4 and 9, which means that the key can be removed only when the latch bolts 140, 141 are closely spaced in latched positions. When turned away from the locked position, the key cylinder 130 preferably retains the key so that removal of the key from the cylinder 130 preferably is permitted only when the key cylinder 130 is turned to its locked position—the position shown in FIGS. 1-4, 8 and 9.

Referring to FIG. 8, it will be seen that the latch bolts 140, 141 are of identical configuration except that one has its orientation reversed so that, in fact, each of the latch bolts 140, 141 has a generally S-shaped configuration that is a mirror image reversal of the configuration of the other. The latch bolts 140, 141 have generally C-shaped inner end regions 240, 241, and outer end regions 340, 341 that carry the tooth formations 440, 441 and 540, 541, respectively. Just as the C-shaped inner end regions 240, 241 are mirror image reversals of each other, so are the tooth formations 440, 540 and 441, 541.

Referring to FIGS. 8-10, in addition to protectively housing the C-shaped inner end regions 240, 241 of the latch bolts 140, 141, interior spaces defined between the front and rear members 112, 114 of the housing 110 also preferably protectively enclose other relatively movable components including a pair of identically configured, elongate links 150, 151, a pair of identically configured pins 160, 161, and a generally cylindrical drive element 190 that is attached to the rear of the plug 130 and turns in unison with the plug 130. Especially if the plug 130 does not provide a key cylinder, the drive element 190 can be integrally formed with the plug 130.

Referring to FIGS. 9 and 10, the cylindrical drive element 190 has a pair of rearwardly extending pin-like projections 290, 291 that turn with the plug 130 between the six o'clock and twelve o'clock positions that are shown in FIG. 9 (where the latch bolts 140, 141 are relatively close together in their latched positions), and the three o'clock and nine o'clock positions shown in FIG. 10 (where the latch bolts 140, 141 are spaced farther apart in their unlatched positions).

Referring to FIGS. 9 and 10, the pin-like projections 290, 291 of the drive element 190 extend through holes formed in first end regions of the elongate links 150, 151, and establish pivotal driving connections between the links 150, 151 and the drive element 190 that cause the links 150, 151 to move from the substantially parallel inclined positions depicted in FIG. 9 to the aligned positions depicted in FIG. 10 when the drive element 190 is turned from the locked/latched position of FIG. 9 to the unlocked/unlatched position of FIG. 10.

As can be seen in FIG. 10, when the latch bolts 140, 141 are moved by the links 150, 151 to the retracted, unlatched positions, the links 150, 151 align along an imaginary line that passes centrally through the plug 130 (i.e., through the axis 135) to prevent movement of the latch bolts 140, 141 toward each other.

Referring to FIG. 8, the pins 160, 161 extend through holes formed through second end regions of the elongate links 150, 151, and through aligned holes formed through the C-shaped inner end regions 240, 241 of the latch bolts 140, 141. The pins 160, 161 have head formations 260, 261 that are received in and are movable along a channel 214 of the rear member 114 of the housing 110. The pins 160, 161 drivingly pivotally connect the links 150, 151 with the latch bolts 140, 141 and cause the latch bolts 140, 141 to move from the locked/latched positions depicted in FIG. 9 to the unlocked/unlatched positions depicted in FIG. 10 in response to turning of the drive element 190 from the position shown in FIG. 9 to the position shown in FIG. 10.

To bring the latch bolts 140, 141 into latched engagement with the latching formations 215 of the strike 200, the latch bolts 140, 141 must first be "retracted" from their closely spaced latched positions by moving them to their relatively widely separated "unlatched" positions as depicted in FIG. 10. When the latch bolts 140, 141 are retracted, the tooth formations 440, 540 of the latch bolt 140 reside behind and are protectively shielded by the post 120, and the tooth formations 441, 541 of the latch bolt 141 reside behind and are protectively shielded by the post 121, as is illustrated in FIG. 10.

When retracted as depicted in FIG. 10, the latch bolts 140, 141 can be inserted (together with their protective posts 120, 121) into the strike openings 220, 221, respectively. After a little more than half of the lengths of the posts 120, 121 have been inserted into the strike-defined openings 220, 221, the plug 130 then can be turned to begin moving the latch bolts 140, 141 toward each other; and, depending on how far the posts 120, 121 are inserted into the openings 220, 221, the latching formations 215 of the strike 200 may be caused to be received either in the notches 1540, 1541 adjacent the tooth formations 540, 541, or in the notches 1440, 1441 adjacent the tooth formations 440, 441.

If, for example, the posts 120, 121 are substantially fully inserted into the strike-defined openings 220, 221 when the latch bolts 140, 141 are moved toward each other (i.e., toward the latched positions of the latch bolts 140, 141 depicted in FIG. 9), the latching formations 215 will be received in the notches 1440, 1441 of the latch bolts 140, 141 adjacent the tooth formations 440, 441, as is illustrated in FIG. 9—and, if an effort is made to withdraw the posts 120, 121 from the openings 220, 221 with the latching formations 215 received in the notches 1440, 1441 of the latch bolts 140, 141 as depicted in FIG. 9, this will cause the latching formations 215 to be engaged by the tooth formations 440, 441 thus preventing withdrawal of the posts 120, 121 from the openings 220, 221.

Alternatively, if the latch bolts 140, 141 are moved toward each other when the posts 120, 121 are only partially inserted into the strike-defined openings 220, 221, it is likely that the latching formations will be received in the notches 1540, 1541 of the latch bolts 140, 141 adjacent the tooth formations 540, 541, which means that attempted withdrawal of the posts 120, 121 from the openings 220, 221 will be prevented when the formations 215 come into engagement with the tooth formations 540, 541.

Those skilled in the art will appreciate that the depicted pair of latching formations 215, and the two pairs of tooth formations 440, 540 and 441, 541 can be replaced by different numbers of pairs of similar or differently configured formations to provide other types of latched engagement between the latch bolts 140, 141 and a suitably configured strike component, without departing from the spirit and scope of the invention contemplated herein.

In FIG. 9, the latching formations 215 are shown extending downwardly quite near to, but not quite into engagement with, the tooth formations 440, 441 of the latch bolts 140, 141, respectively. In may instances, this lack of engagement between the tooth formations 440, 441 and the latching formations 215 (at a time when the posts 120, 121 are considered to be fully inserted into the strike-defined openings 220, 221) is not what is desired, for it invites rattling of the "latched" latch 100 in the presence of vibration. Accordingly, it will be understood that some embodiments do, in fact, use latching formations 215 that extend slightly farther downwardly than is illustrated in FIG. 9 to actually physically engage the tooth formations 440, 441 when all other components of the latch 100 and the strike 200 exhibit the appearance depicted in FIG. 9. However, such engagement is non-essential to the operation of the latch 100—but it is preferred if minimizing rattling of relatively movable components in the presence of vibration is desired.

Referring to FIGS. 8-10, an additional step that can be taken to minimize unwanted rattling of relatively movable components in the presence of vibration is to include a compression coil spring 170 in the open space between the front member 112 and the rear member 114 of the housing 110. The spring 170 preferably is situated between the C-shaped inner end regions 240, 241 of the latch bolts 140, 141 but is actually engaged both of the C-shaped inner end regions 240, 241 only when the latch bolts 140, 141 are in, or very nearly in, their latched positions, as depicted in FIG. 9. When the latch bolts 140, 141 are in their unlatched positions, as depicted in FIG. 10, the spring 170 is not compressed by the inner end regions 240, 241; but, when the latch bolts 140, 141 move to the latched positions of FIG. 9, the spring 170 is slightly compressed between the C-shaped inner end regions 240, 241 and thereby serves to prevent rattling of the relatively movable components of the latch 100 in the presence of vibration.

The embodiment disclosed in the drawings brings several advantages into play that do not obtain with the latch disclosed in the referenced Martinez patent. Instead of providing a pair of latch bolts that pivot to and from positions extending along a single post-like projection, and instead of relying on the biasing action of housing-carried springs to effect unlatching movements of the latch bolts, the dual-action latch disclosed in the drawings hereof provides a pair of slidably movable latch bolts situated at spaced locations wherein each of the latch bolts is associated with a separate one of two post-like projections, and wherein each of the latch bolts is caused to move (not only from its unlatched position to its latched position, but also from its latched position to its unlatched position) by the positive driving action of links that connect the latch bolts to a plug or key cylinder that, when turned in one direction will cause positive unlatching movement of both of the latch bolts, and when turned in the opposite direction will cause positive latching movement of both of the latch bolts. In the depicted embodiment, neither latch bolt can move independently of the other, and no springs are relied on to effect latch bolt movement.

As regards the strike, instead of relying on latching formations provided at opposite ends of a single strike-defined opening to engage closely spaced latch bolts, the embodiment depicted in the drawings hereof utilizes latching formations provided at ends of a pair of spaced strike-defined openings to engage correspondingly spaced latch bolts.

Instead of utilizing tooth formations that project from opposite outer sides of a single post-like projection and readily can be damaged if they should accidentally move from their protected unlatched positions so as to be inappropriately engaged during efforts to align and insert the post-like projection into a strike-defined opening, the embodiment depicted in the drawings hereof utilizes pairs of tooth formations that face inwardly toward each other at locations between spaced post-like projections, and the tooth formations are well shielded from undesired engagement by their associated post-like projections.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. It is intended that such patentable features as are disclosed herein be protected by the claims that follow.

What is claimed is:

1. A latch having a housing from which project two substantially parallel extending posts configured to be insertable concurrently into openings defined by a strike at locations on opposite sides of a latching formation also defined by the strike, first and second latch bolts slidable on the housing each extending along a separate one of the posts to define at least one tooth formation that is engageable with the latching formation when the posts are inserted into the openings, and a plug rotatable on the housing and drivingly connected by first and second links to the first and second latch bolts, respectively, with the plug and the links cooperable to slide the latch bolts toward each other when the plug is turned in one direction, and away from each other when the plug is turned in an opposite direction, wherein the first and second links are pivotally connected to the plug and to the first and second latch bolts.

2. The latch of claim 1 wherein the first and second links are elongate, and pins pivotally connect end regions of the first and second links to the plug and to the first and second latch bolts.

3. The latch of claim 1 wherein the plug and the links cooperate to slide the latch bolts away from each other to positions adjacent the posts where the posts prevent the tooth formations from engaging the latching formation in response to turning the plug in the opposite direction, and to positions wherein the tooth formations can latchingly engage spaced surfaces of the latching formation in response to turning the plug in the one direction.

4. A latch having a housing from which project two substantially parallel extending posts configured to be insertable concurrently into openings defined by a strike at locations on opposite sides of a latching formation also defined by the strike, first and second latch bolts slidable on the housing each extending along a separate one of the posts to define at least one tooth formation that is engageable with the latching formation when the posts are inserted into the openings, and a plug rotatable on the housing and drivingly connected by first and second links to the first and second latch bolts, respectively, with the plug and the links cooperable to slide the latch bolts toward each other when the plug is turned in one direction, and away from each other when the plug is turned in an opposite direction, wherein the housing encloses only one spring, and the only one spring engages the first and second latch bolts only for the purpose of minimizing rattling in the presence of vibration and only when the latch bolts are moved toward each other as the result of turning the plug in the one direction.

5. A latch comprising:

a) a strike that defines first and second latching formations adjacent first and second spaced openings, respectively;

b) a housing that defines first and second substantially parallel extending posts insertable concurrently into the first and second openings, respectively;

c) first and second latch bolts slidably supported by the housing for non-pivotal movement toward and away from each other, with the first latch bolt having a formation that extends along the first post to define at least one first tooth formation that faces toward the second post, with the second latch bolt having a formation that extends along the second post to define at least one second tooth formation that faces toward the first post;

d) a plug turnable relative to the housing between unlatched and latched positions, and drivingly connected to the first and second latch bolts by links that pivotally connect to the plug 1) to move the latch bolts away from each other to positions where the tooth formations cannot engage the latching formations in response to turning the plug in one direction, and 2) to move the latch bolts toward each other to positions wherein the first and second tooth formations can latchingly engage the first and second latching formations, respectively, in response to turning the plug in an opposite direction;

e) wherein the plug is turnable between the unlatched and latched positions only when a suitably configured key is inserted into a keyway defined by the plug; and, f) wherein the key is removable from the plug only when the plug is turned to the latched position, and wherein the links are pivotally connected to the first and second latch bolts at first and second locations.

6. The latch of claim 5 wherein the links are of elongate form, are enclosed by the housing, and are configured to extend along an imaginary line that passes centrally through the plug when the plug is turned to the unlatched position to prevent movement of the first and second latch bolts until the plug is turned out of the unlatched position.

7. The latch of claim 5 including a compression coil spring carried by the housing at a position between the first and second latch bolts where opposed portions of the spring are engaged by the first and second latch bolts when the latch bolts are moved to the positions wherein the first and second tooth formations can latchingly engage the first and second latching formations, respectively.

8. The latch of claim 5 wherein the first and second latch bolts are defined by first and second metal stampings, respectively, having configurations that are mirror image reversals of each other, and wherein the first and second links are also defined by metal stampings which drivingly connect the plug with the first and second latch bolts, respectively.

9. The latch of claim 8 wherein the first and second links are substantially identical elongate members having holes formed through their opposite end regions, and wherein pin-like formations extend through the holes to pivotally connect the first and second links to the plug and to the first and second latch bolts.

10. A latch comprising:

a) a strike that defines first and second latching formations adjacent first and second spaced openings, respectively;

b) a housing that defines first and second substantially parallel extending posts insertable concurrently into the first and second openings, respectively;

c) first and second latch bolts slidably supported by the housing for non-pivotal movement toward and away from each other, with the first latch bolt having a formation that extends along the first post to define at least one first tooth formation that faces toward the second post, with the second latch bolt having a formation that extends along the second post to define at least one second tooth formation that faces toward the first post;

d) a plug turnable relative to the housing between unlatched and latched positions, and drivingly connected to the first and second latch bolts by links that pivotally connect to the plug 1) to move the latch bolts away from each other to positions where the tooth formations cannot engage the latching formations in response to turning the plug in one direction, and 2) to move the latch bolts toward each other to positions wherein the first and second tooth formations can latchingly engage the first and second latching formations, respectively, in response to turning the plug in an opposite direction; and, e) wherein the first latch bolt carries at least two first tooth formations, the second latch bolt carries at least two second tooth formations, the first latching formation is configured to latchingly engage one at a time each of the first tooth formations, and the second latching formation is configured to latchingly engage one at a time each of the second tooth formations.

11. A latch, comprising:

a) a strike attachable to one of two members that are to be latched together, and defining first and second latching formations of similar configuration located, respectively, near adjacent portions of first and second similarly configured spaced-apart openings defined by the strike;

b) a housing attachable to the other of the two members and defining first and second similarly configured, substantially parallel extending posts that are spaced and configured to permit their being concurrently inserted into the first and second openings, respectively;

c) first and second latch bolts slidably connected to the housing have first and second elongate regions that extend alongside the first and second posts, respectively, and that carry first and second tooth formations, respectively, configured to latchingly engage the first and second latching formations, respectively, when moved toward each other after being inserted concurrently with the first and second posts into the first and second openings, respectively;

d) a plug connected to the housing and turnable between latched and unlatched positions;

e) first and second elongate links each having an end region pivotally connected to the plug, with the first link having an opposite end region pivotally connected to the first latch bolt, with the second link having an opposite end region pivotally connected to the second latch bolt, and with the links being configured to move the first and second latch bolts away from each other when the plug is turned to the unlatched position, and to move the first and second latch bolts toward each other when the plug is turned to the latched position;

f) whereby, turning the plug to the unlatched position causes the first and second latch bolts to move substantially concurrently away from each other to positions that permit the elongate regions of the latch bolts and the posts of the housing to be moved substantially concurrently into and out of the openings, and turning the plug to the latched position at a time when the first and second elongate regions of the latch bolts and the first and second posts of the housing are inserted into the first and second openings of the strike, respectively, causes the first and second tooth formations to move substantially concurrently into latched engagement with the first and second latching formations, respectively, of the strike.

12. The latch of claim 11 wherein the plug is turnable between the unlatched and latched positions only when a suitably configured key is inserted into a keyway defined by the plug.

13. The latch of claim 12 wherein the key is removable from the plug only when the plug is turned to the latched position.

14. The latch of claim 11 including a compression coil spring carried by the housing at a position between the first and second latch bolts where opposed portions of the spring are engaged by the first and second latch bolts when the latch bolts latchingly engage the latching formations to minimize rattling that might result should the latch be subjected to vibration.

15. The latch of claim 11 wherein the first and second posts shield the first and second tooth formations from being contacted by the first and second latching formations during movement of the first and second posts into and out of the first and second openings, respectively.

16. A latch having a housing from which project two substantially parallel extending posts configured to extend concurrently into openings defined by a strike at locations on opposite sides of a latching formation also defined by the strike, a pair of latch bolts slidable on the housing with each of the latch bolts including an elongate formation that extends along a separate one of the posts to define a tooth formation that is engageable with the latching formation, and a plug rotatable on the housing and connected by separate housing-enclosed links to each of the latch bolts and operable to slide the latch bolts toward each other when the lug is turned in one direction, and away from each other when the plug is turned in an opposite direction, wherein the links are of elongate form and extend substantially parallel to each other within the housing, and each of the links is pivotally connected to a separate one of the latch bolts and to the plug.

17. The latch of claim 16 wherein the latch bolts have configurations that are mirror image reversals of each other, with each of the configurations including a substantially C-shaped formation enclosed by the housing, with one end region of each C-shaped formation pivotally connected to a separate one of the links.

* * * * *

UNITED STATES PATENT AND TRADEMARK OFFICE

CERTIFICATE OF CORRECTION

PATENT NO. : 7,497,103 B1
APPLICATION NO. : 11/715177
DATED : March 3, 2009
INVENTOR(S) : Michael O. Misner It is certified that error appears in the above-identified patent and that said Letters Patent is hereby corrected as shown below:

In Claim 16, column 14, line 26, cancel "lug" and substitute therefor --plug--.

Signed and Sealed this

Fourteenth Day of April, 2009

JOHN DOLL
*Acting Director of the United States Patent and Trademark Office*